US006551698B1

(12) United States Patent
Martin et al.

(10) Patent No.: US 6,551,698 B1
(45) Date of Patent: Apr. 22, 2003

(54) METHOD FOR TREATING A SILICON SUBSTRATE, BY NITRIDING, TO FORM A THIN INSULATING LAYER

(75) Inventors: François Martin, Grenoble (FR); Daniel Bensahel, Grenoble (FR); Caroline Hernandez, Grenoble (FR); Laurent Vallier, Neylon (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 09/763,532

(22) PCT Filed: Sep. 20, 1999

(86) PCT No.: PCT/FR99/02228

§ 371 (c)(1),
(2), (4) Date: Apr. 4, 2001

(87) PCT Pub. No.: WO00/17412

PCT Pub. Date: Mar. 3, 2000

(30) Foreign Application Priority Data

Sep. 21, 1998 (FR) ..... 98 11746

(51) Int. Cl.[7] ..... C23G 16/02

(52) U.S. Cl. ..... 428/210; 428/469; 427/581; 427/585

(58) Field of Search ..... 428/210; 427/581, 427/585

(56) References Cited

U.S. PATENT DOCUMENTS

| | | | | |
|---|---|---|---|---|
| 4,438,157 A | | 3/1984 | Romano-Moran | |
| 5,407,870 A | | 4/1995 | Okada et al. | |
| 5,512,519 A | | 4/1996 | Hwang | |
| 5,674,788 A | | 10/1997 | Wristers et al. | |
| 5,843,817 A | * | 12/1998 | Lee et al. | 438/239 |

FOREIGN PATENT DOCUMENTS

| | | | |
|---|---|---|---|
| EP | 0430030 | 6/1991 | |
| EP | 0798769 | 10/1997 | |
| FR | 9801963 | 2/1998 | |
| JP | 0 827 199 A2 * | 4/1998 | ..... H01L/23/31 |
| WO | WO90/03560 | 4/1990 | |
| WO | WO98/27580 | 6/1998 | |

OTHER PUBLICATIONS

B.Y Kim, et al. "Ultra Thin (<3nm) High Quality Nitride/Oxide Stack Gate Dielectrics Febricated by In–Situ Rapid Thermal Processing"1997, P.463–466. (No month).

Francois Martin, et al. "LPCVD $Si_3$ $N_4$ growth retardation on silicon native oxide compared with *in situ* HF vapour–deglazed silicon substrates" *Semcond. Sci. Technol.* 6 (1991) P.1000–102. (No month).

L.F. Tz. Kwakman, et al. "Quantification of $Si_3$ $N_4$ LPCVD inhibition on oxide surfaces" *applied surface Science* (1993) P.629–633. (No month).

Kiyoteru Kobayashi, et al. "Ultrathin Silicon Nitride Films Fabricated by Single–Wafer Processing Using an $SiH_2$ $CI_2$ – $NH_3$ –$H_2$ System and *In Situ* H2 Cleaning" *J. Electrochem. Soc.*, vol. 143, Apr. 1996, P. 1459–1464.

Shigehiko Saida, et al. "Single Layer Nitride Capacitor Dielectric Film and High Concentration Doping Technology for 1Gb/4Gb Trench–type DRAMs" *IEEE 1997* P.265–268. (No month).

* cited by examiner

*Primary Examiner*—Deborah Jones
*Assistant Examiner*—Vivek Koppikar
(74) *Attorney, Agent, or Firm*—Thelen Reid & Priest LLP; Robert E. Krebs

(57) ABSTRACT

Method for preparing a silicon substrate to form a thin electric insulating layer (24), characterized in that it comprises:

a deoxidation step of at least one part of the silicon substrate (10), then a heat treatment step of the substrate at a temperature of 750° C. or less, the heat treatment being conducted in a NO-containing atmosphere at a pressure of $5.10^3$ Pa (50 mBr) or less, in order to form a layer of silicon oxynitride (22) on the substrate. Use for the production of EPROM and DRAM memories.

10 Claims, 1 Drawing Sheet

METHOD FOR TREATING A SILICON SUBSTRATE, BY NITRIDING, TO FORM A THIN INSULATING LAYER

"This application is a national phase of PCT/FR99/02228 which was filed on Sep. 20, 1999, and was not published in English."

TECHNICAL FIELD

The present invention relates to a method for treating a silicon substrate for the purpose of forming, on at least one of its surfaces, a layer of electric insulating material such as, for example, a layer of silicon nitride.

The invention finds applications in the production of electronic devices with components having a thin electric insulating layer, and in particular for the production of DRAM type memories (dynamic random access memory) or EPROM memories (erasable/programmable read only memory).

It may also be applied to the production of electronic circuits having insulated gate transistors such as MOS transistors or other components such as capacitors.

STATE OF THE PRIOR ART

The increased performance of electronic components in terms of frequency, integration and electric capacity for memories, is accompanied by a reduction in the thickness of the electric insulating layers, in particular of the gate layers of these devices.

The gate layer, for components made on a silicon substrate is usually a layer of silicon oxide.

The reduction in the thickness of the oxide layer to values of less than 3 nm gives rise to problems relating to the diffusion of doping impurities derived from overlying active layers, through the oxide layer. This diffusion has adverse effects on the reliability and performances of the components comprising the oxide layer.

The problem of the diffusion of doping impurities may be remedied, at least in part, by incorporating in the gate layer oxide of the components an appropriate dose of nitrogen, in particular by means of a nitriding treatment. In particular, the oxide layer may be combined with or optionally replaced by a layer of silicon nitride.

Also, to illustrate the fabrication of thin nitride layers in DRAM and EPROM structures, reference may be made to documents [1], [2], [3], [4] and [5] whose references are specified at the end of this disclosure.

Document [1] in particular shows that it is not possible to form a homogeneous, continuous nitride layer thinner than 5 nm on a layer of native oxide on the surface of a substrate.

For applications such as the fabrication of memories, however, gate thicknesses of less than 5 nm are required.

Document [2] suggests solving the problems of continuity or non-homogeneity of the thin nitride layers (<3 nm) by subjecting them to quick annealing in an atmosphere of $NH_3$ at temperatures in the order of 950° C. Nevertheless, it arises that such annealing, owing to its high temperature, may deteriorate the electronic components previously formed in the substrate.

Documents [3] and [4] describe techniques with which a layer of native oxide, initially present on the surface of a silicon substrate, is removed before the formation of a nitride layer by chemical vapour deposition on the exposed silicon surface. Deoxidation of the substrate may take place by annealing under hydrogen or by chemical means using hydrofluoric acid.

Finally, document [5] proposes forming on the substrate a layer of silicon oxynitride, prior to the layer of silicon nitride. The oxynitride layer is formed in an atmosphere of NO. The silicon nitride layer is then is formed from the gases $SiH_4$ and $NH_3$ in a reactor of monoplate type. Enriching the treatment gases with silane ($SiH_4$) promotes nucleation of the silicon nitride but deteriorates its stoicheiometric quality. The use of a monoplate reactor is also scarcely compatible with industrial production of components with low production costs.

The methods of documents [3], [4] and [5] also entail treatments at high temperatures, in the order of 800°C. to 1000° C., and use high heat schedules.

For a certain number of components, however, in particular structures of embedded DRAM type, it is sought on the contrary to reduce the heat schedules as much as possible, that is to say the time and length of heat treatments. High heat schedules and high treatment temperatures are harmful for the components.

DISCLOSURE OF THE INVENTION

The object of the invention is to put forward a method for preparing a substrate with which it is possible to form a thin layer of electric insulator which does not have the above-mentioned difficulties.

One object in particular is to put forward such a method enabling the formation of a continuous, homogeneous, thin nitride layer on a silicon substrate.

A further object of the invention is to put forward a method which uses lower heat schedules and temperatures.

To reach these objects, the subject of the invention is more precisely a method for treating a silicon substrate so as to form a thin, electric, insulating layer. In accordance with the invention, the method comprises, in order:

- a deoxidation step of at least part of the silicon substrate, then
- a heat treatment step of the substrate at a temperature of 750° C. or less, the heat treatment being made in a NO-containing atmosphere, at a pressure of $5.10^3$ Pa (50 mBar) or less, and preferably less than $10^3$ Pa (10 mBar) in order to form on the substrate a layer of silicon oxynitride, and
- a formation step to form, at least on said part of the substrate, a layer of electric insulating material.

By a NO-containing atmosphere is meant an atmosphere of pure NO or NO diluted with an inert gas such as nitrogen or argon.

With the heat treatment it is possible, on the surface of the deoxidised part of the substrate, to form a very fine layer of silicon oxynitride whose thickness may be less than one nanometre. This layer enables the subsequent formation of a thin insulating layer that is homogeneous and continuous.

Moreover, the oxynitride layer prevents the formation on the substrate of parasite deposits of metallic oxides such as $Ta_2O_5$ whose onset may occur during oxidizing treatments.

The heat treatment of the method is applied at temperatures of less than 750° C., for example at a temperature in the order of 550° C. The method may therefore be applied to substrates comprising electronic components that are relatively sensitive to heat, previously formed.

Preferably, the heat treatment may be applied for a sufficient length of time to obtain an oxynitride layer having a thickness of between 0.5 and 1.5 nm.

As an example, the heat treatment may be conducted at a temperature in the region of 550° C., a pressure in the order of $10^3$ Pa (10 mBar) for a time of approximately 30 seconds to obtain an oxynitride layer of 0.7 nm.

The silicon substrate used may have been previously subjected to prior treatment in order to form electronic components therein or parts of electronic components.

The layer of electric insulating material formed on the substrate may be a layer of silicon nitride ($Si_3N_4$) or a layer of $Ta_2O_5$ chosen for their strong dielectric constant.

In respect of a layer of silicon nitride $Si_3N_4$, this may be preferably formed by a method of LPCVD type (Low Pressure Chemical Vapour Deposition) in the presence of an atmosphere containing dichlorisilane ($SiH_2Cl_2$) and/or ammonia $NH_3$. The deposit is made at a temperature of 750° C. or less, for example 700° C.

The invention also concerns a substrate, which may be obtained according to the above-described method and which, in order, comprises a layer of silicon with at least one area devoid of native oxygen, a layer of silicon oxynitride having a thickness of between 0.5 and 1.5 nm in contact with said area, and a layer in an electric insulating material having a thickness of between 2 and 5 nm in contact with said layer of silicon oxynitride. The electric insulating material may be chosen from among $Si_3N_4$ and $Ta_2O_5$ for example.

Other characteristics and advantages of the invention will become better apparent from the following description with reference to the figures of the appended drawings. This description is given solely for illustration purposes and is not restrictive.

DETAILED DESCRIPTION OF PARTICULAR EMBODIMENTS OF THE INVENTION

Figure 1:
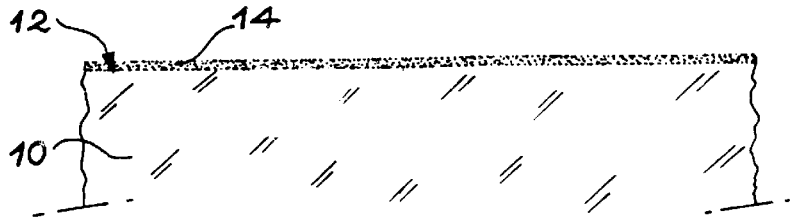
FIG. 1 is a diagram of one portion of a silicon substrate, before applying the preparation method according to the invention.

FIG. 1 shows one part of a silicon substrate 10, monocrystalline or polycrystalline, with a free surface designated by the reference 12.

Surface 12 is coated, before the treatment, with an oxide layer 14. The oxide layer 14 may be a layer of native oxide which is naturally formed by contact of the silicon with air, or an oxide layer obtained by a heat treatment.

The silicon substrate may contain components or parts of components, such as transistor channels or memory structures for example. These components or parts of components shall not be described in detail here, nor are they shown in the figures since they may vary depending upon the considered application.

A first step of the method is a deoxidation step whose purpose is to remove the oxide layer 14.

Deoxidation may be made by chemical means by immersing the substrate 10 in a solution of hydrofluoric acid diluted in water. The concentration of the acid is in the order of 1%, even lower.

Figure 2:
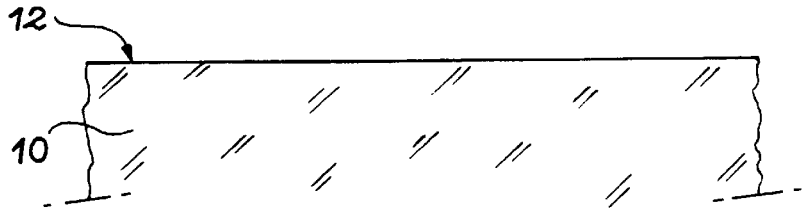
FIGS. 2 and 3 are successive diagrams of the portion of substrate shown in FIG. 1 after the deoxidation and heat treatment steps of the invention.

After the first step a substrate according to FIG. 2 is obtained, for which the free surface 12 is exposed.

Figure 3:
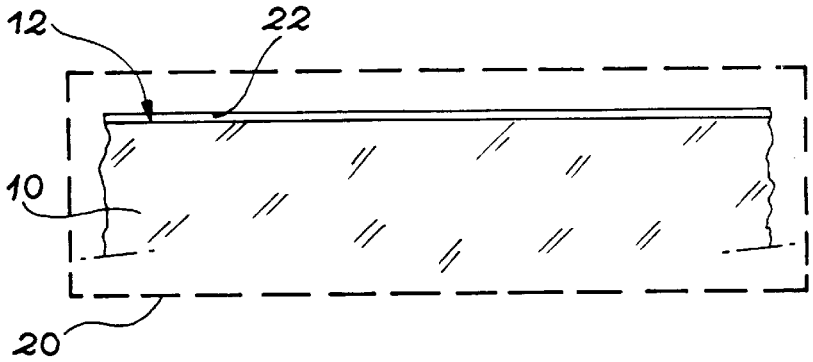

As shown in FIG. 3, the substrate is then placed in a chamber 20 in which an atmosphere of NO is set up.

The gas pressure in the chamber 20 is in the order of $5.10^3$ Pa (50 mBar), or less.

In this chamber, the substrate undergoes a heat treatment at a temperature of less than 750° C., and preferably less than 700° C. when the fabricated components are DRAMs, to form a layer 22 of silicon oxynitride, having the formula SixNyOz, on surface 12. (The parameters x, y and z are stoicheiometric parameters).

Table I below gives the proportions of Si, O and N of the oxynitride layer 22 for heat treatments conducted at 550° C. and 700° C., at a pressure of $10^3$ Pa and for 30 seconds. The table also gives the thickness of the layers of silicon oxynitride obtained.

TABLE I

| Composition | Si % | O % | N % | Thickness |
|---|---|---|---|---|
| 700° C. | 35 | 49 | 16 | 0.92 nm |
| 550° C. | 37 | 45 | 17 | 0.65 nm |

Table I shows that the composition of the layer of silicon oxynitride undergoes little change with treatment temperature. The thickness, however, is affected.

Figure 4:
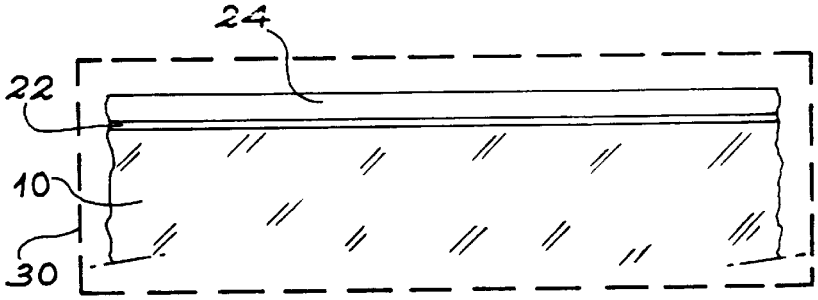
FIG. 4 is a diagram of a portion of the substrate shown in FIG. 3 on which a thin insulating layer has been formed.

The substrate so prepared may receive an electric insulating layer. In the described example, and as shown in FIG. 4, a layer of silicon nitride 24 is formed on the oxynitride layer 22.

The formation of the silicon nitride may take place in an oven 30 in which an atmosphere containing a mixture of $NH_3$/DCS (ammonia/dichlorosilane) is set up.

The formation of the nitride takes place by low pressure chemical vapour deposition (LPCVD) at a temperature of less than 750° C., for example between 700° C. and 750° C.

The nucleation properties of the silicon nitride on substrate 10 are largely improved through the presence of the layer of silicon oxynitride 22 which overcomes delay in nucleation. By nucleation properties is meant in particular the kinetic properties of nucleation comprising the incubation time/ and or the density of the nucleation sites formed after a certain time period.

If $Ta_2O_5$ is used as insulator, the oxynitride layer prevents oxidation between Si and $Ta_2O_5$.

By way of illustration, table II gives the thickness of the layers 22 of silicon oxynitride and of layers 24 of silicon nitride for three samples treated differently.

A first control sample did not undergo the method of the invention, but comprised a layer of silicon oxide on its surface. Two other samples were prepared in accordance with the invention in an atmosphere of NO at $10^3$ Pa for 30 seconds. The samples were then given a LPCVD deposit of silicon nitride under equivalent conditions, at 700° C., with a $NH_3$/DCS ratio of 9, and for a time period in the order of 10 to 20 minutes.

TABLE II

| | Nitriding conditions/ NO | Thickness of oxynitride layer 22 | Thickness of nitride layer 24 | Difference |
|---|---|---|---|---|
| Sample 1 (control) | none | 0.9 nm (oxide | 3.5 nm | 2.55 nm |

TABLE II-continued

| | Nitriding conditions/ NO | Thickness of oxynitride layer 22 | Thickness of nitride layer 24 | Difference |
|---|---|---|---|---|
| | | layer) | | |
| Sample 2 | 550° C./30" | 0.7 nm | 4.44 nm | 3.74 nm |
| Sample 3 | 700° C./30" | 0.92 nm | 4.5 nm | 3.58 nm |

Table II shows a change in nucleation delay. The existence of the layer of silicon oxynitride 22, under identical LPCVD deposit conditions, makes it possible to obtain more rapid nitride formation.

Also, the nitride layers 24 are homogeneous and continuous, despite their narrow thickness.

Cited Documents

[1] FR-98 01963

[2] L. F. Tz Kwakman, E. J. Lindow, E. H. A. Granneman, F. Martin, J. C. Veler and J. P. Joly, Applied Surface Science 70/71, p. 629–633 (1933).

[3] S. Saida, T. Sato, I. Mizushima, Y. Ozawa, Y. Tsunashima, Extended Abstract of the IEDM, p. 265 (1997).

[4] K. Kobayashi, Y. Inaba, T. Ogata, T. Katayama, H. Watanabe, Y. Matsui, M. Hiramaya, Journal of the Electrochemical Society, vol. 143, No. 4, p. 1459 (1996).

[5] B. Y. Kim, H. F. Luan, D. L. Kwong, Extended Abstract of the IEDM, p. 463 (1997).

[6] F. Martin, F. Bertin, H. Sprey, E. Granneman, Semicond. Sc. Technol. 6, p. 1100 (1991).

What is claimed is:

1. A method for treating a silicon substrate comprising:

a deoxidation step of at least one part of the silicon substrate (10); then a heat treatment step of the substrate at a temperature of 750° C. or less, the heat treatment being conducted in a NO-containing atmosphere at a pressure of $5.1 \cdot 10^3$ Pa (50 mBar) or less, wherein said heat treatment step is applied for a sufficient length of time to obtain a layer of silicon oxynitride (22) having a thickness of between 0.5 and 1.5 nm, and a formation step wherein a layer of electric insulating material is formed on the layer of silicon oxynitride.

2. Method according to claim 1, in which deoxidation is conducted by chemical means and by immersing the substrate in a dilute solution of hydrofluoric acid.

3. Method according to claim 1 in which the heat treatment is conducted at a temperature 550° C., a pressure in the order of $10^3$ Pa (10 mBar) for a time period of approximately 30 seconds.

4. Method according to claim 1, in which the layer of electric insulating material (24) is formed by low pressure chemical vapour deposition.

5. Method according to claim 1, in which the layer of electric insulating material (24) is formed at a temperature of 750° C. or less.

6. Method according to claim 1, in which the electric insulating material is selected from the group consisting of $Si_3N_4$ and $Ta_2O_5$.

7. Method according to claim 1, in which the layer of electric insulating material (24) has a thickness of between 2 and 5 nm.

8. Method according to claim 1, in which the layer of electric insulating material is $Si_3N_4$ is formed, by low pressure chemical vapour deposition, in the presence of $Si_2H_2Cl_2$.

9. Substrate comprising, in order, a layer of silicon (10) with at least one area (12) devoid of native oxygen, a layer (22) of silicon oxynitride having a thickness of between 0.5 and 1.5 nm in contact with said area (12), and a layer of an electric insulating material having a thickness of between 2 and 5 nm, in contact with said layer of silicon oxynitride.

10. Substrate according to claim 9, in which the electric insulating material is selected from the group consisting of $Si_3N_4$ and $Ta_2O5$.

* * * * *